US005829962A

United States Patent [19]

Drasek et al.

[11] Patent Number: 5,829,962

[45] Date of Patent: Nov. 3, 1998

[54] METHOD AND APPARATUS FOR OPTICAL FLAME CONTROL OF COMBUSTION BURNERS

[75] Inventors: William Von Drasek, Oak Forrest; Louis C. Philippe, Oakbrook Terrace; Eric L. Duchateau, Clarendon Hills, all of Ill.

[73] Assignees: L'Air Liquide, Societe Anonyme Pour L'Etude Et, L'Exploitation Des Procedes Georges, Paris, France; American Air Liquide, Inc., Walnut Creek, Calif.

[21] Appl. No.: 797,020

[22] Filed: Feb. 7, 1997

Related U.S. Application Data

[63] Continuation-in-part of Ser. No. 655,033, May 29, 1996, abandoned.

[51] Int. Cl.[6] ..... F23N 5/08

[52] U.S. Cl. ..... 431/79; 431/12; 431/13; 431/25

[58] Field of Search ..... 431/79, 12, 25, 431/13

[56] References Cited

U.S. PATENT DOCUMENTS

| | | | |
|---|---|---|---|
| 4,534,728 | 8/1985 | Vogels | 431/80 |
| 4,588,372 | 5/1986 | Torborg | 431/78 |
| 4,607,256 | 8/1986 | Henzel | 340/825.52 |
| 4,696,639 | 9/1987 | Bohan, Jr. | 431/59 |
| 4,756,684 | 7/1988 | Nishikawa et al. | 431/79 |
| 4,770,629 | 9/1988 | Bohan, Jr. | 431/59 |
| 4,934,926 | 6/1990 | Yamazaki et al. | 431/75 |
| 5,023,426 | 6/1991 | Prokosch et al. | 219/121.63 |
| 5,071,105 | 12/1991 | Donze et al. | 266/51 |
| 5,077,550 | 12/1991 | Cormier | 340/578 |
| 5,123,739 | 6/1992 | Takenouchi et al. | 356/319 |
| 5,126,721 | 6/1992 | Butcher et al. | 431/13 X |
| 5,141,294 | 8/1992 | Van Zanten et al. | 303/182 |
| 5,191,220 | 3/1993 | Innes et al. | 250/554 |
| 5,222,713 | 6/1993 | Lawless et al. | 251/129.06 |
| 5,233,152 | 8/1993 | Prokosch et al. | 219/121.63 |
| 5,480,298 | 1/1996 | Brown | 431/79 |

FOREIGN PATENT DOCUMENTS

| | | |
|---|---|---|
| 36 16 344 A1 | 11/1987 | Germany . |
| 40 24 832 C1 | 8/1991 | Germany . |
| 40 10 570 A1 | 10/1991 | Germany . |
| 40 28 922 C2 | 7/1992 | Germany . |
| 60-129524 | 7/1985 | Japan . |
| 7-91656 | 4/1995 | Japan . |
| 2 280 023 | 1/1995 | United Kingdom . |

OTHER PUBLICATIONS

UV–Detectors UVS 6, UVS 8, From Schroder, pp. 1–4, Dec. 1992.

*Primary Examiner*—Larry Jones
*Attorney, Agent, or Firm*—Jeffrey L. Wendt

[57] ABSTRACT

In accordance with the present invention, methods and apparatus to control or monitor the combustion of a burner are presented which overcome many of the problems of the prior art. One aspect of the invention comprises a burner control apparatus comprising means for viewing light emitted by a flame from a burner, means for optically transporting the viewed light into an optical processor, optical processor means for processing the optical spectrum into electrical signals, signal processing means for processing the electrical signals obtained from the optical spectrum, and control means which accept the electrical signals and produce an output acceptable to one or more oxidant or fuel flow control means. The control means may be referred to as a "burner computer", which functions to control the oxidant flow and/or the fuel flow to the burner. In a particularly preferred apparatus embodiment of the invention, a burner and the burner control apparatus are integrated into a single unit, which may be referred to as a "smart" burner.

14 Claims, 10 Drawing Sheets

METHOD AND APPARATUS FOR OPTICAL FLAME CONTROL OF COMBUSTION BURNERS

CROSS-REFERENCE TO RELATED APPLICATIONS

This application is a continuation-in-part of assignee's patent application Ser. No. 08/655,033, filed May 29, 1996, abandoned.

BACKGROUND OF THE INVENTION

1. Field of the Invention

The present invention relates generally to burner control, and more specifically to methods and apparatus for controlling combustion efficiency in burners.

2. Description of the Related Art

Numerous industrial processes such as glass or fritt melting, ferrous and nonferrous materials smelting, ladle preheating, billets reheating, waste incineration and vitrification, crude oil refining, petrochemical production, power plants, and the like use burners as the primary source of energy, or as an auxiliary source of energy. These burners possess one or more inlets for fossil fuels of high calorific value such as natural gas, liquefied petroleum gas, liquid hydrocarboneous fuel, and the like, which are combusted to produce heat. Some burners also comprise inlets for low calorific content gases or liquids that need to be incinerated. The fuels are burned in a combustion chamber where the energy that is released by the combustion is transferred to the furnace load. The combustion requires an oxidant, such as air, oxygen enriched air, or oxygen, and the oxidant is preferably preheated. The oxidant is also supplied by the burners.

Precise and reliable control of the combustion is very important for the efficiency and the safety of industrial processes, as will be understood by those skilled in the art.

For instance, it is well known that combusting a fuel with excess oxidant yields higher nitrogen oxides (NOx) emission rates, especially when the oxidant is preheated or when the oxidant is pure oxygen. On the other hand, incomplete combustion of a fuel generates carbon monoxide (CO). Both NOx and CO are very dangerous pollutants, and the emission of both gases is regulated by environmental authorities.

Combustion of a fuel with an uncontrolled amount excess of air can also lead to excessive fuel consumption and increase the production cost of the final product.

Safety of operation is an essential characteristic expected from all industrial combustion systems. Automated control of the presence of the flame in the combustion can be used to stop the flow of oxidant when the fuel flow is suddenly interrupted.

Commercially available UV flame detectors can be used to control the status (flame on or off) of a flame. However, this type of combustion control device does not give any information on the combustion mixture. It is impossible to know whether the burner is operated under fuel rich (excess of fuel, combustion ratio lower than 1), fuel lean (excess of oxidant, combustion ratio greater than 1), or stoichiometric (exact amounts of fuel and oxidant to obtain complete combustion of the fuel, combustion ratio equal to 1). UV flame detectors are typically self contained devices that are not always integrated in the burner design.

Endoscopes are also often used in the industry to visually inspect flames, and their interaction between the furnace load. They are generally complicated and expensive pieces of equipment that require careful maintenance. To be introduced into very high temperature furnaces, they require external cooling and flushing means: high pressure compressed air and water are the most common cooling fluids. When compressed air is used, uncontrolled amounts of air are introduced in the furnace and may contribute to the formation of NOx. Water jackets are subject to corrosion when the furnace atmosphere contains condensable vapors.

Control of combustion ratio at a burner can be performed by metering the flows of fuel and oxidant, and using valves (electrically or pneumatically driven) controlled by a programmable logic controller (PLC). The ratio of oxidant to fuel flow is predetermined using the chemical composition of the natural gas, and of the oxidant. To be effective, the flow measurement must be very accurate and retaliated on a regular basis, which is not always the case, especially when the oxidant is air. This situation often leads the furnace operator to use large excess of air to avoid the formation of CO. This feed-forward combustion control strategy does not account for the air intakes that naturally occur in industrial furnaces and bring unaccounted quantities of oxidant into the firebox, nor does this control scheme account for the variation of the air intakes caused by furnace pressure changes. Another drawback is that the response time of the feed-forward regulation loop is generally slow, and can not account for cyclic variations of oxidant supply pressure and composition that occur when the oxidant is impure oxygen, for example as produced by a vacuum swing adsorption unit or membrane separator. Yet another drawback of the feed-forward control of combustion ratio is that the PLC should be reprogrammed at every occurrence of a change in natural gas supply and composition.

Placing an in-situ oxygen sensor at the furnace exhaust can provide a feed-back control solution for global combustion ratio control. However, zirconia sensors for oxygen that are commercially available have limited lifetime and need to be replaced frequently. One difficulty met when using these sensors is a tendency to plug, especially when the exhaust gases contain volatile species, such as in a glass production furnace. When the furnace possesses more than one burner, a drawback of global combustion control is that it is not possible to know whether each individual burner is properly adjusted or not. This technique also has long response times due to the residence times of the furnace gases in the combustion chamber, which can exceed 30 seconds.

Continuous CO monitoring of the flue gas, for example in so-called post combustion control of an electric arc furnace, provides another means of controlling the combustion. It involves the use of a sophisticated exhaust gas sampling system, with separation of the particulate matter and of the water vapor. Although very efficient, these techniques are not always economically justified.

Other combustion control devices use acoustic control of flames. Most of these systems were developed for small combustion chambers in order to avoid extinction of flames, and are triggered by instabilities of flames.

The light emission observed from flame is one of the most characteristic features providing information on the chemical and physical processes taking place. Monitoring the flame light emission can be easily performed in well controlled environments typically found in laboratories. However, implementing flame light emission monitoring on industrial burners used on large furnaces is quite difficult in practice, resulting in a number of problems. First, optical access is necessary which requires positioning of a viewport in a strategic location with respect to the flame for collecting the flame light emission. Second, the plant environment is difficult because of the excessive heat being produced by the furnace. Typical optical ports on a furnace can have temperatures in excess of 1000° C., thus necessitating the need for water cooled or high flow-rate gas cooled probes or use either in or near the furnace. Finally, these environments tend to be very dusty which is not conductive for optical equipment except with special precautions, such as gas purging over the optical components.

While currently available systems have been able to achieve some degree of control over the combustion in a burner, there is a need for a fast response time control apparatus that avoids the previously described problems.

SUMMARY OF THE INVENTION

In accordance with the present invention, methods and apparatus to control or monitor the combustion of a burner are presented which overcome many of the problems of the prior art. One aspect of the invention comprises a burner control apparatus comprising means for viewing light emitted by a flame from a burner, means for optically transporting the viewed light into an optical processor, optical processor means for processing the optical spectrum into electrical signals, signal processing means for processing the electrical signals obtained from the optical spectrum, and control means which accept the electrical signals and produce an output acceptable to one or more oxidant or fuel flow control means. The control means may be referred to as a "burner computer", which functions to control the oxidant flow and/or the fuel flow to the burner. In a particularly preferred apparatus embodiment of the invention, a burner and the burner control apparatus are integrated into a single unit, which may be referred to as a "smart" burner.

Another aspect of the invention is a method of controlling the combustion ratio of a burner, the method comprising the steps of:

(a) viewing light emitted by a flame from a burner;

(b) optically transporting the viewed light into an optical processor;

(c) optically processing the viewed light into usable light wavelengths and light beams;

(d) generating electrical signals with the usable wavelengths and beams; and (e) controlling the input of an oxidant and/or a fuel into the burner using the electrical signals. Preferred methods of the invention are those wherein the light from the flame is viewed and optically transported using optical fibers.

This invention provides a unique method and apparatus for monitoring the flame emission on an industrial burner for use of an industrial process. The method is general enough to monitor flame emission in the ultraviolet, visible, or infrared spectral regions, allowing individual regions, multiple regions or single wavelengths to be monitored. Many of the problems of previous control mechanisms are avoided by adapting the burner housing with a window and/or an optical fiber positioned with respect to either the fuel injector or oxidizer injector, as will be seen further from the detailed description of the invention.

DESCRIPTION OF PREFERRED EMBODIMENTS

Figure 1:
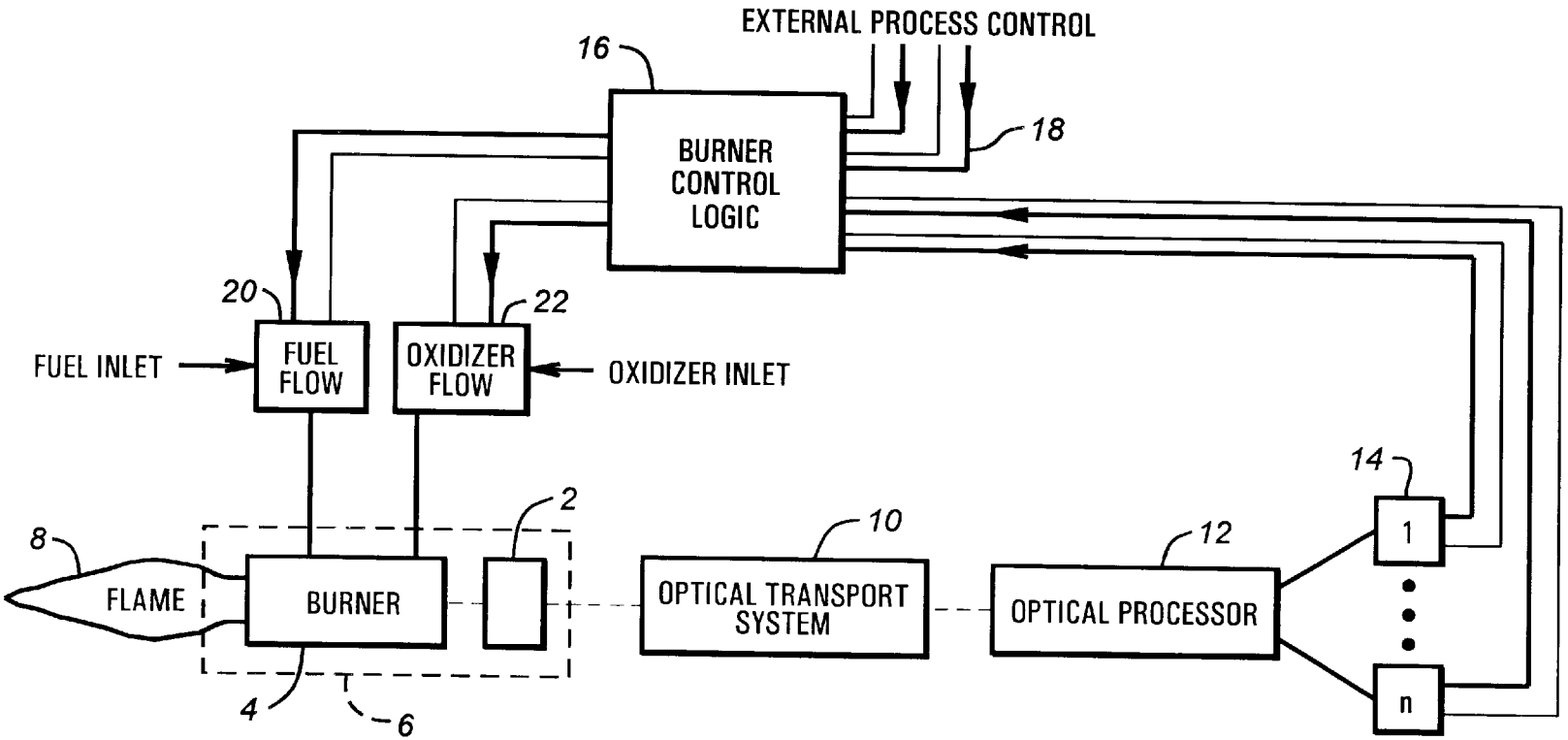
FIG. 1 represents a schematic block diagram of an apparatus of the invention.

A schematic block diagram of a preferred flame control apparatus of the invention is illustrated in FIG. 1. The apparatus comprises an optical coupling element 2 which functions to collect light emitted from a flame 8. Preferably, element 2 is an optical fiber. Optical coupling element 2 is preferably an integral part of a burner 4, the optical element and burner preferably housed in a single unit 6 (boxed area). After the light emission is collected it is transported by an optical transport system 10, which can either be one or more optical fibers or a plurality of lenses.

Optical processing is performed in an optical processor 12 to obtain characteristic information on specific spectral regions of the flame. For example, optical processor 12 may be an optical filter that allows only radiation of selected wavelengths to pass. This radiation may be monitored by either a photodiode or photomultiplier detector. Preferred optical processors of the apparatus of the invention employ one or more optical beam splitters, optical filters and optical detectors. This allows one to monitor simultaneously multiple regions of the flame light emission spectrum.

Alternatively, a dispersion element could preferably be used in the optical processor to monitor complete spectral regions of the flame. Dispersion elements can be employed in a manner similar to an optical filter by tuning the dispersion element to a specific wavelength (or range of wavelengths) and monitoring the flame emission spectrum in a narrow spectral wavelength range, or by scanning the element (similar to a spectrometer) to collect a much larger spectral wavelength range. In this case a photodiode or photomultiplier that is sensitive to the wavelength range of interest can be used to convert the optical wavelength into an electrical signal that can be further processed. An array detector can also be used in conjunction with the dispersion element, allowing real-time detection of an entire spectral wavelength range of interest. Finally, all of the above mentioned detection methods can be used in combination with one another by using optical beam splitters or multiplexed optical fibers, with the appropriate number of multiple detection methods as described above.

After optical processing of the flame radiation the electrical signal(s) obtained is sent to one or more signal processors 14 which preferably comprise analog/digital converters, amplifiers, line drivers, or any other typical signal processing circuit device (FIG. 1). The electrical signal is then transmitted to a burner logic controller 16 that determines operating conditions of burner 4. BLC 16 may accept other input signals from external process controls 18, such as a furnace supervision system. BLC 16 generates control signals that change the burner operating parameters (such as flow of fuel 20, and/or flow of oxidant 22) according to the information transmitted by signal processors 14. Suitable programmable logic controllers usable as BLCs are available from Siemens Co. Process control software, such as that available from Ocean Optics, Inc. may be employed to program the BLC.

This preferred combustion control apparatus can advantageously be implemented on every burner installed on an industrial furnace in order to more precisely control the combustion ratio of the whole furnace.

As previously noted, all of the components illustrated in FIG. 1 may be integrated into a so-called smart burner. In this aspect of the invention, the burner may be equipped with a fuel control valve and an oxidant control valve. Solid-state proportioning valves, such as those disclosed in U.S. Pat. No. 5,222,713, may be employed for controlling flow, but the use of the valves is not necessary to the present invention. The previous patent is incorporated herein by reference.

Figure 2:
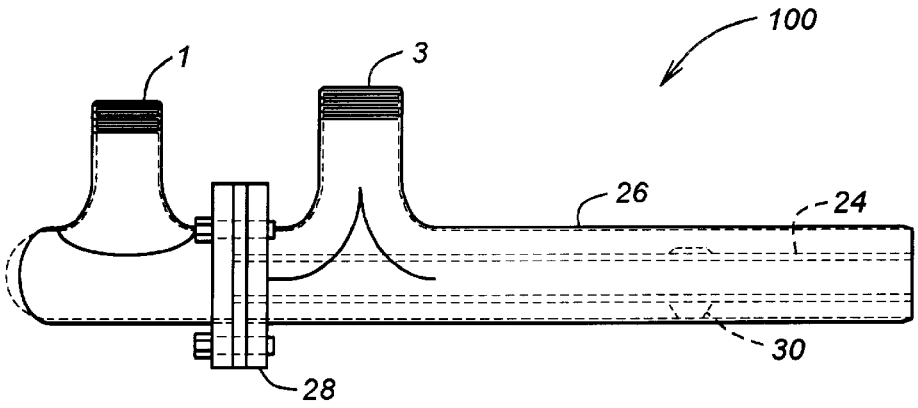
(PRIOR ART) FIG. 2
FIG. 2 represents a side elevation view of a prior art burner (reduced in scale) without any optical access.

FIG. 2 illustrates a prior art pipe-in-a-pipe burner 100 with inlets for fuel 1 and oxidant 3. In FIG. 2, burner 100 includes a fuel pipe 24 within an oxidant pipe 26. A flange and bolt arrangement 28 is typically employed. A support 30 is used to maintain the position of pipe 24 inside pipe 26, preferably concentric.

Figure 3:
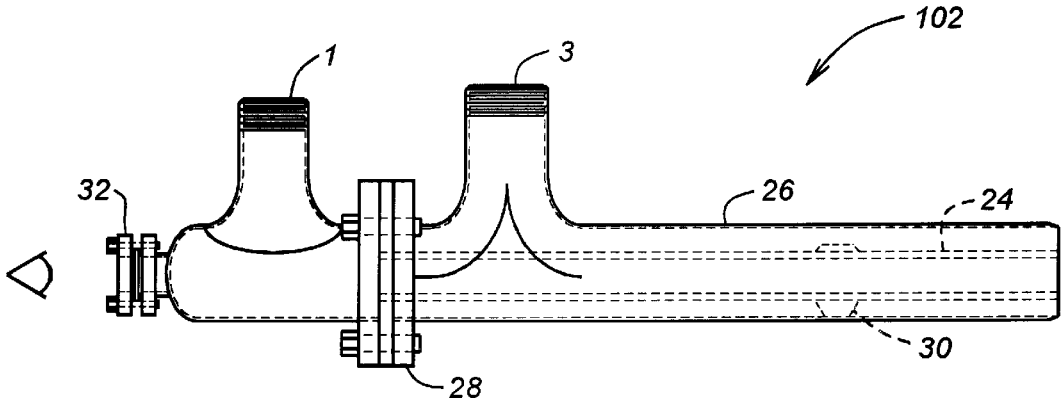
FIG. 3 represents the burner of FIG. 2 on which a window has been installed so that light emitted by the flame can be directed to an optical sensor.
Figure 4:
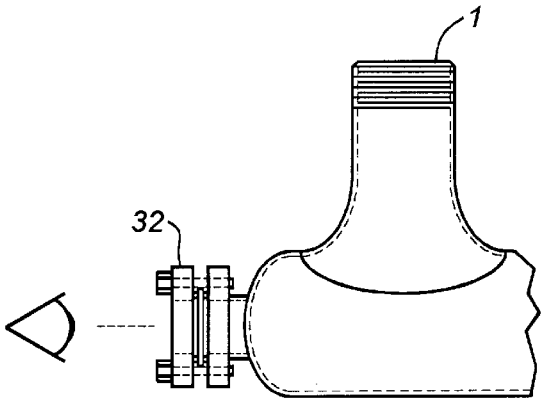
FIG. 4 represents a detailed view of the optical coupling of FIG. 3.

A schematic of a burner 102 modified to allow optical coupling with a window is illustrated in FIG. 3. In this embodiment, a window 32 is mounted on the rear of the burner such that optical access is provided through fuel injector pipe 24, as indicated in the detailed view of FIG. 4. The window material selected is preferably specific to the spectral region of interest. For example, if the ultraviolet region of the spectrum is of interest, then a quartz window would be applicable. However if infrared emission is of interest, then a sapphire window material would be suitable. An optical component, such as a combination of lenses, can be used to collect either the integrated emission along the length of the flame, or the emission from a selected point in the flame.

Figure 5:
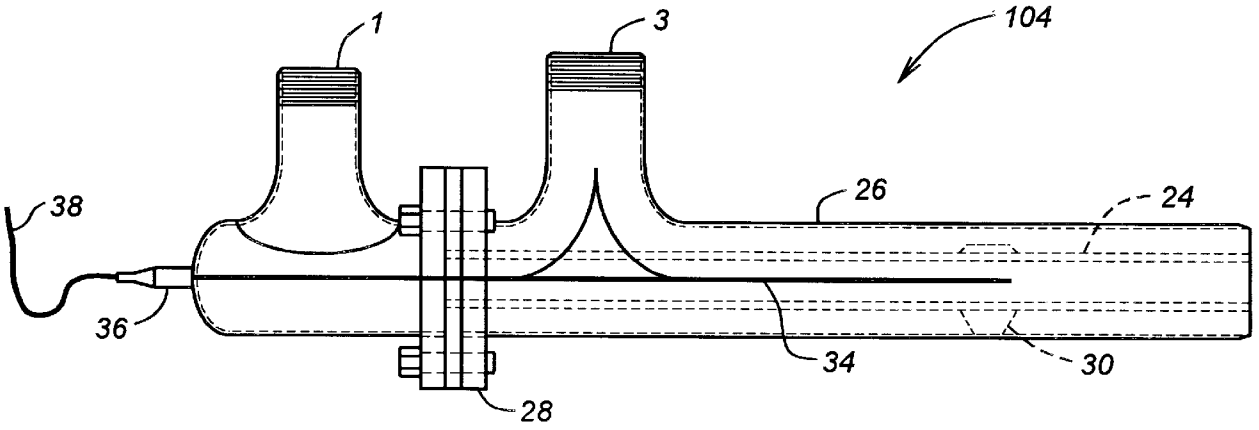
FIG. 5 represents the burner of FIG. 2 in which the optical coupling is an optical fiber having one extremity installed in a fuel injector.
Figure 6:
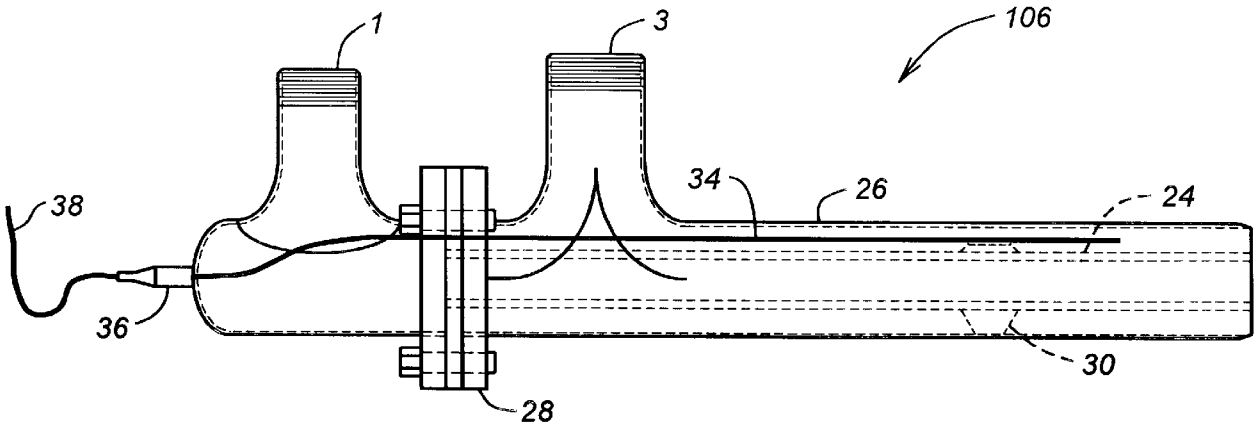
FIG. 6 represents the burner of FIG. 2 in which the optical coupling is an optical fiber having one extremity installed in an oxidant injector.

In the preferred embodiments illustrated in FIGS. 5 and 6, the flame emission is collected by an optical fiber 34 that is positioned in one of the burner injectors (fuel (FIG. 5) or oxidant (FIG. 6)). The choice of fiber material used depends on the spectral region of interest. Useable optical fibers preferably have core diameters varying from about 50 to about 300 micrometers, more preferably from about 175 to about 225 micrometers, and made from silica, with a stainless steel cladding outer layer. A seal between the fiber and burner housing can be a simple o-ring compression. Optical connector 36 connects optical fiber 34 to a second optical fiber 38 in each of these two exemplary embodiments. For the embodiments of FIGS. 5 and 6 the collected emission may also be integrated over the flame length or collected from a selected focused point in the flame for improved spectral resolution.

By adapting the burner housing with a window and/or optical fiber positioned with respect to the fuel injector and/or oxidant injector, the flame emission may be collected through the burner housing. For either case the gas flow over the window or optical fiber provides cooling while also keeping the optical surface free of dust.

The intensity of the emitted flame radiation detected depends on the wavelength region that is being observed. This wavelength dependence results from chemiluminescence of excited state chemical species, continuum emission from atom molecule reactions, and continuum emission from the presence of particles either being entrained or formed in the flame. These effects can be classified as purely chemical, i.e., the observed flame radiation is only a result of the chemical process taking place with no external influences. In addition to the pure chemical effects, other factors can influence the spectrum intensity such as, characteristics of how the fuel and oxidizer are mixed, burner, background contributions and entrainment of chemical species into the flame, furnace, and the method used to collect the radiation, e.g. optical system. Therefore the flame radiation intensity observed in a process can be expressed as a multivariable function:

$$I_\lambda = \text{—} f(\mathrm{B, S, P, OD, OC, F, O}, \rho)\,dV \tag{1}$$

where $I_\lambda$ is the observed intensity at wavelength $\lambda$ integrated over the sample volume. This intensity is a function of the burner (B) characteristics, combustion stoichiometry (S), burner power (P), optical collection system (OC), and optical detector (OD), fuel (F), oxidizer (O), and process ($\rho$) disturbances.

In addition these variables can also be time dependent. For example, in turbulent diffusion flames the mixing between fuel and oxidizer at a fixed location in the flame will vary with time, i.e., the local stoichiometry (S) and power (P) are changing randomly within some range. The variable $\rho$ may also be considered time dependent, e.g., when particle entrainment into the flame is not constant. A more general expression for the observed intensity becomes $$I_\lambda(t) = \text{—} f(\mathrm{B, S}(t), \mathrm{OC, OD, F, O}, \rho(t))\,dV \tag{2}$$

In general the variables B, OD, OC, F, O can be considered time invariant. Of course, burner or collection optic degradation can occur, which can result the in $I_\lambda$ changing. However, these effects can usually be considered long term, i.e., the time scale for $I_\lambda$ to change from B, OD, and OC is much greater than that for the variables S, P, and $\rho$. The variables F (fuel) and O (oxidizer) may change from day-to-day because of the source being changed. In this case, the sensitivity of $I_\lambda$ to changing F or O would need to be determined.

Because most industrial processes are stochastic in nature an average value of $I_\lambda$ is more practical to work with. Here the time-averaged value of $I_\lambda(t)$, denoted by $\langle I_\lambda(t)\rangle$, is defined as the integral on time over a time interval T, divided by the time interval:

$$<I_\lambda(t)> = \frac{1}{T}\int_t^{t+T} I_\lambda(t)dt \tag{3}$$

The magnitude of the time interval T needs only to be long enough to average out the fluctuations.

For practical applications such as, process control of a burner the variables OC, OD, B, F and O are generally constant, e.g., the burner configuration, collection optics and optical detector are not changed once the system is in place. As stated above they may also be coincided time invariant. Then Eq. (3) reduces to the following:

$$<I_\lambda(t)>=\text{——}f(S(t), P(t))dV \tag{4}$$

where ρ(t) was assumed negligible. Furthermore the total integrated intensity observed over a wavelength range can be expressed as $$\Gamma = \int_{\lambda_1}^{\lambda_2} <I_\lambda(t)>d\lambda \tag{5}$$

Since $I_\lambda$=f(S,P) then it follows that Γ=f(S,P). The change in the integrated intensity can then be related to the changes in S and P by the relation $$d\Gamma = \left(\frac{\partial\Gamma}{\partial S}\right)_P dS + \left(\frac{\partial\Gamma}{\partial P}\right)_S dP \tag{6}$$

A solution to the above equation can be obtained once the partial derivatives are determined. Evaluation of the partial derivatives can be obtained by performing a calibration over a range of operating conditions at constant P and then at constant S. This will give the relationships $\Gamma_P$=f(S) and $\Gamma_S$=f(P) that can be used to evaluate Eq. (6), where the subscript denotes the constant variable. This calibration can then be used for controlling and monitoring the burner stoichiometry and power. The following example illustrates how these partial derivatives can be obtained from experimental measurements.

Figure 11:
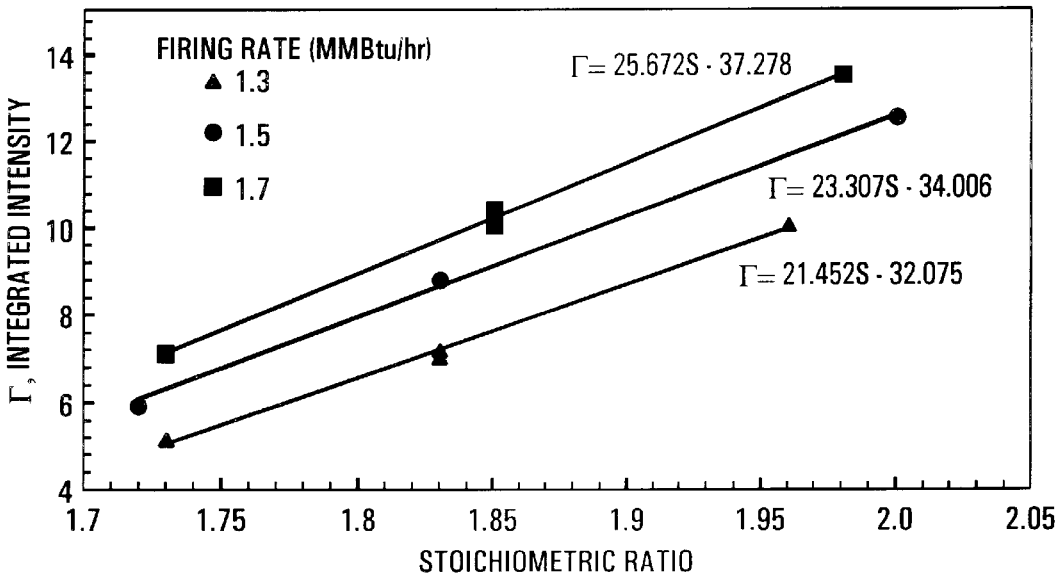
FIG. 11 is a graphical representation of integrated intensity versus stoichiometric ratio.
Figure 12:
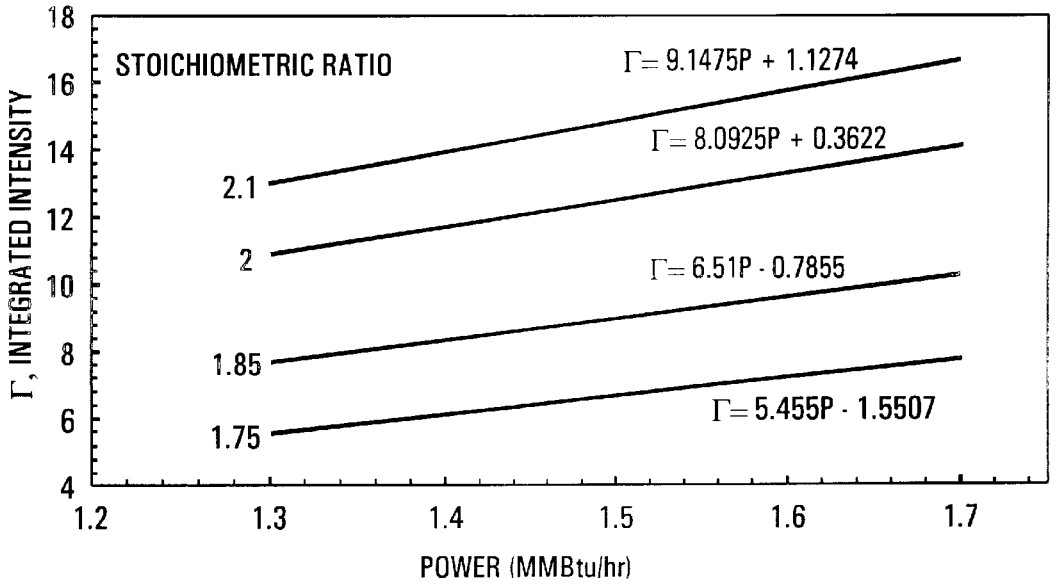
FIG. 12 is a graphical representation of integrated intensity versus power.
Figure 13:
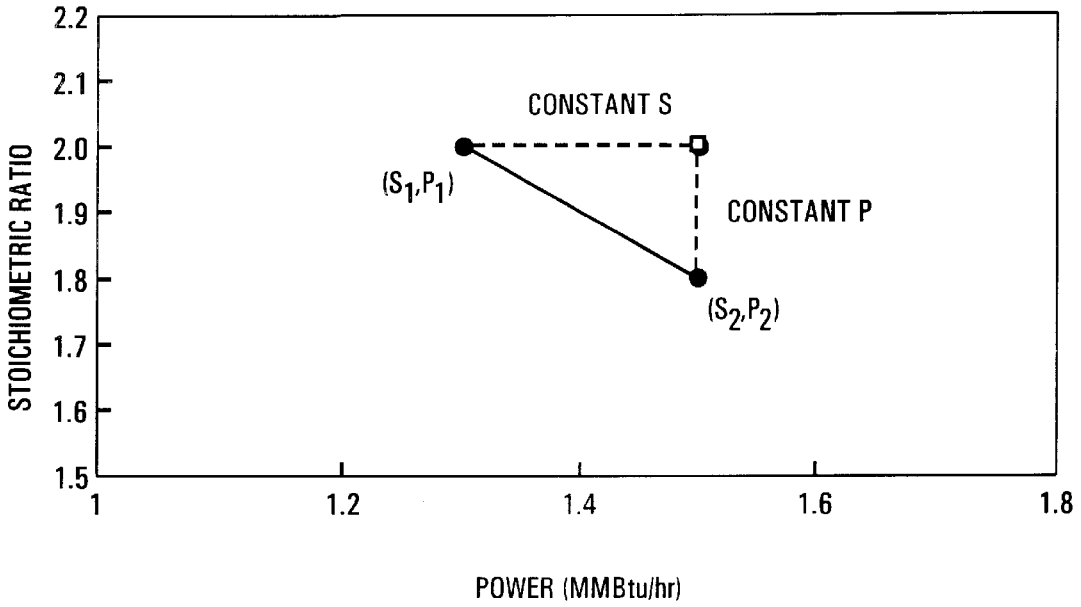
FIG. 13 is a graphical representation of stoichiometric ratio versus power.

In this example the flame emission is monitored using the configuration shown in FIG. 5, i.e., the flame emission was observed through the NG injector. Flame radiation was transported by a 12 ft long 100 μm diameter fiber optic attached at the rear of the burner. At the other end the fiber was attached to an Ocean Optics model PC 1000 PC spectrometer board with a spectral range of 290–800 nm. The variables OC, OD, O, F, B, and ρ are held constant only P and S are changed. Note, the influence of the furnace, which is lumped into ρ, can be neglected provided the flame emission is observed below 400 nm. At longer wavelengths background radiation from the furnace walls would have to be included. In the spectral region between 300 and 400 nm the changes in stoichiometry and power can be observed by either monitoring the OH peak or part of the continuum, e.g., between 340–360 nm. In this example the fuel is natural gas and the oxidizer is oxygen therefore the theoretical stoichiometric ratio is 2, where the stoichiometric ratio is defined as (moles of oxygen/moles of fuel). Here $CH_4+2O_2$–>$2H_2O+CO_2$. FIGS. 11 and 12 shows the integrated OH intensity ($\lambda_1$=290 nm and $\lambda_2$=325 nm in Eq. (5)) at different stoichiometries and burner powers. For a given power level a linear fit can be obtained over the stoichiometric range tested. Similarly, for fixed stoichiometrics a linear fit can be obtained over the power range tested, as shown in FIG. 12. The linear fits for both P and S result in a family of curves. To solve for dΓ, Eq. (6) can be integrated from ($S_1$, $P_1$) to ($S_2$, $P_2$). The integration is performed along a path of constant P first then along a path of constant S as shown in FIG. 13, where the partial derivatives are evaluated from the linear calibration functions shown in FIGS. 11 and 12.

Figure 14:
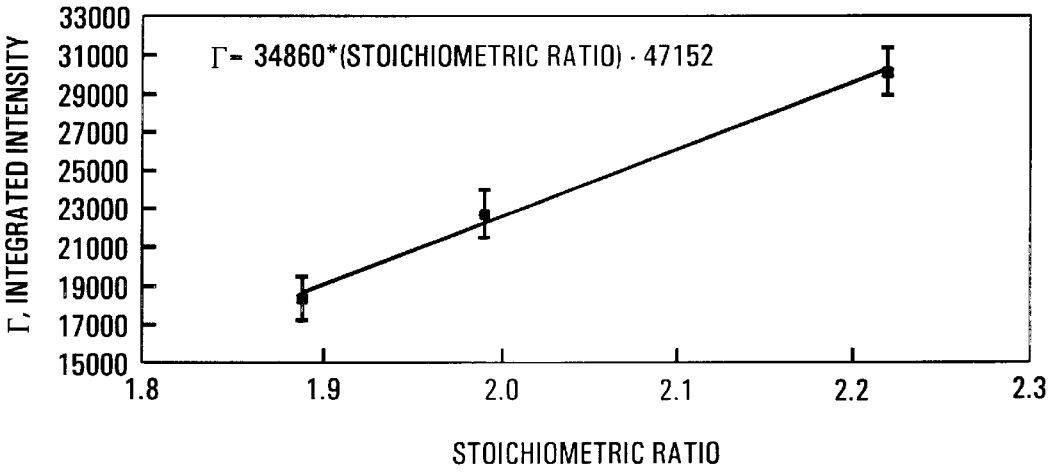
FIG. 14 is a graphical representation of integrated intensity versus stoichiometric ratio at constant power.
Figure 15:
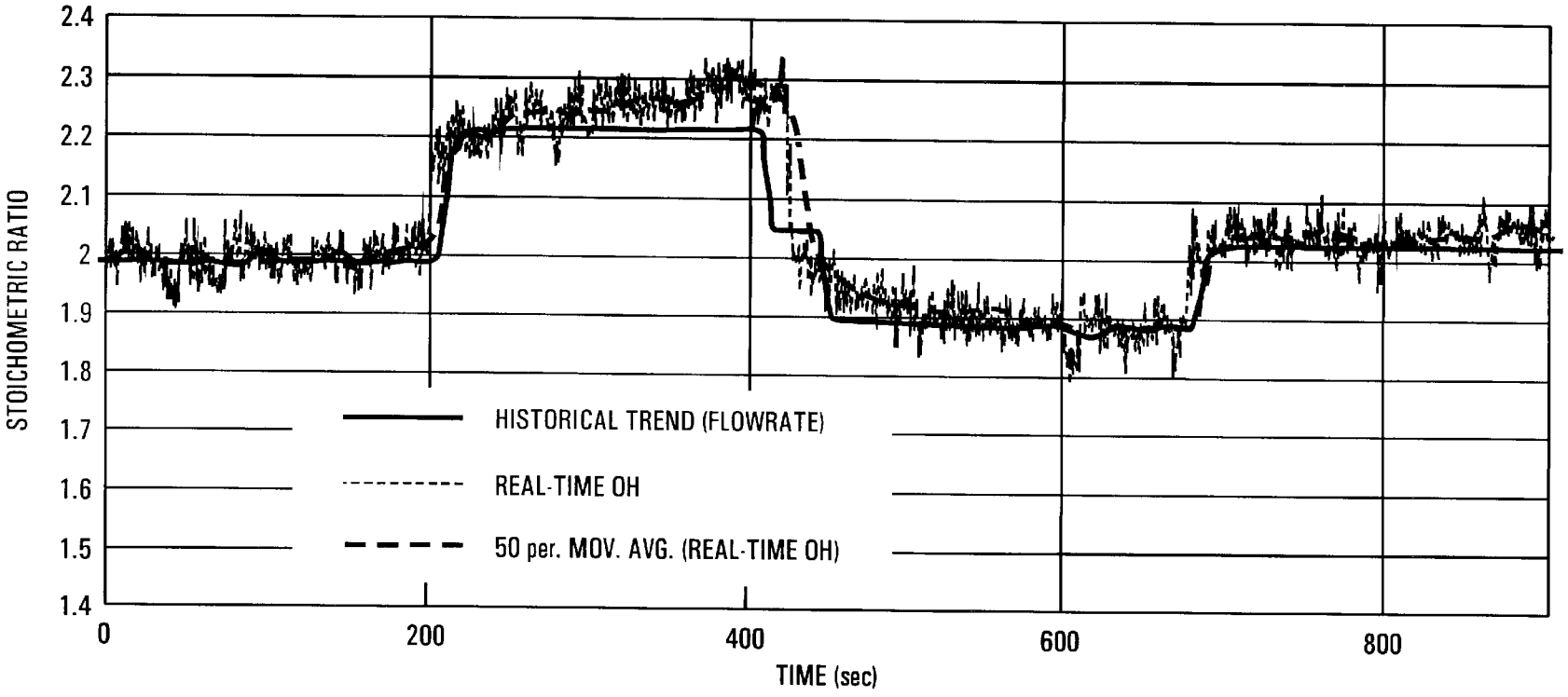
FIG. 15 is a graphical representation of stoichiometric ratio versus time at a constant power.

The next example illustrates how the technique can be used for controlling operating conditions of a burner. In this example, the same configuration as discussed above is used and all variables are fixed except the stoichiometry (S). Prior to the test a calibration was performed to determiners $\Gamma_\rho$=f(S) by monitoring the integrated OH emission intensity at different stoichiometric ratios and a constant power of 1.5 MMBtu/hr. The calibration provides a good linear fit over the stoichiometric ratio range of 1.88–2.22 tested, as shown in FIG. 14. In FIG. 14 the error bars represent the standard deviation for 180 samples at each stoichiometric condition. The calibration provides a linear function of the form Γ=AS+B, where A and B are constants. Using this expression with Eq. (6) and upon and rearrangement the following equation for stoichiometry is obtained:

$$S_2 = S_1 + \left(\frac{\Gamma_2 - \Gamma_1}{A}\right) \tag{7}$$

where $S_1$ and $\Gamma_1$ are known values for this example ($S_1$=2 and $\Gamma_1$=22,568 counts) and can be considered as set-point values. Incorporating Eq. (7) into a computer algorithm for real-time processing of the integrated OH signal allows the stoichiometry to be monitored at a high sampling rate as shown in FIG. 15. In FIG. 15 the integrated intensity Γ is sampled at 3 Hz. The sampling rate reported here is limited by the computer hardware used. Higher sampling rates are certainly feasible. The dashed line shows the result of a 50 point moving average that is applied to remove temporal fluctuations. These results show good agreement with the stoichiometric ratios based on flow rate measurements of both NG and oxygen, shown as the solid line marked historical trend in FIG. 15.

To adapt this methodology for process control applications of a burner Γ would be monitored and S and/or P could then be obtained. However, in the example case presented here either S or P must be constant or determined independently.

Examples of Optical Processors and Burner Logic Control

As stated previously the radiation emitted from a flame is one of the fundamental characteristics that provides information on the chemical and physical process involved. The capability to monitor this flame radiation can provide numerous applications useful for optimizing the furnace operation.

Here we cite a number of examples of how the flame emission can be used to control the combustion.

EXAMPLE 1

Safety Alarm

Detection of the flame radiation can be used to identify the presence or absence of the flame. If the signal level drops below a set-point level an alarm can be triggered, indicating a problem with the burner. For this case a region in the ultraviolet, for example, below 300 nanometers (nm), would be best to discriminate against visible and infrared emission from the furnace walls. Typically furnaces use UV flame monitors for detection of the flame. This application would provide not only a secondary backup detection system, but could also alert the operator of other problems. For example, severe damage to the burner such as material build-up causing the flame to deflect, or a piece of refractory blocking the burner exit. For these cases the emission characteristics could change, setting off an alarm indicating a potential problem. In general, commercial UV flame monitors are presently used only to indicate the presence or absence of flame radiation.

EXAMPLE 2

Flame Stoichiometry Monitoring

In this application a specific region of the spectrum may be monitored to provide information on the flame stoichiometry. For example, in the combustion of natural gas (NG) and oxygen, a strong continuum in the wavelength range of 350–700 nm is present with a maximum occurring near 650 nm. The continuum is thought to result from chemiluminescence from the recombination reaction of $CO+O=>CO_2$. The strength (intensity) of this continuum has been observed to be related to whether the burner is operating near stoichiometric conditions. When operating under fuel-rich conditions the observed continuum intensity is weaker as compared to slightly fuel-lean or stoichiometric operating conditions.

Figure 7:
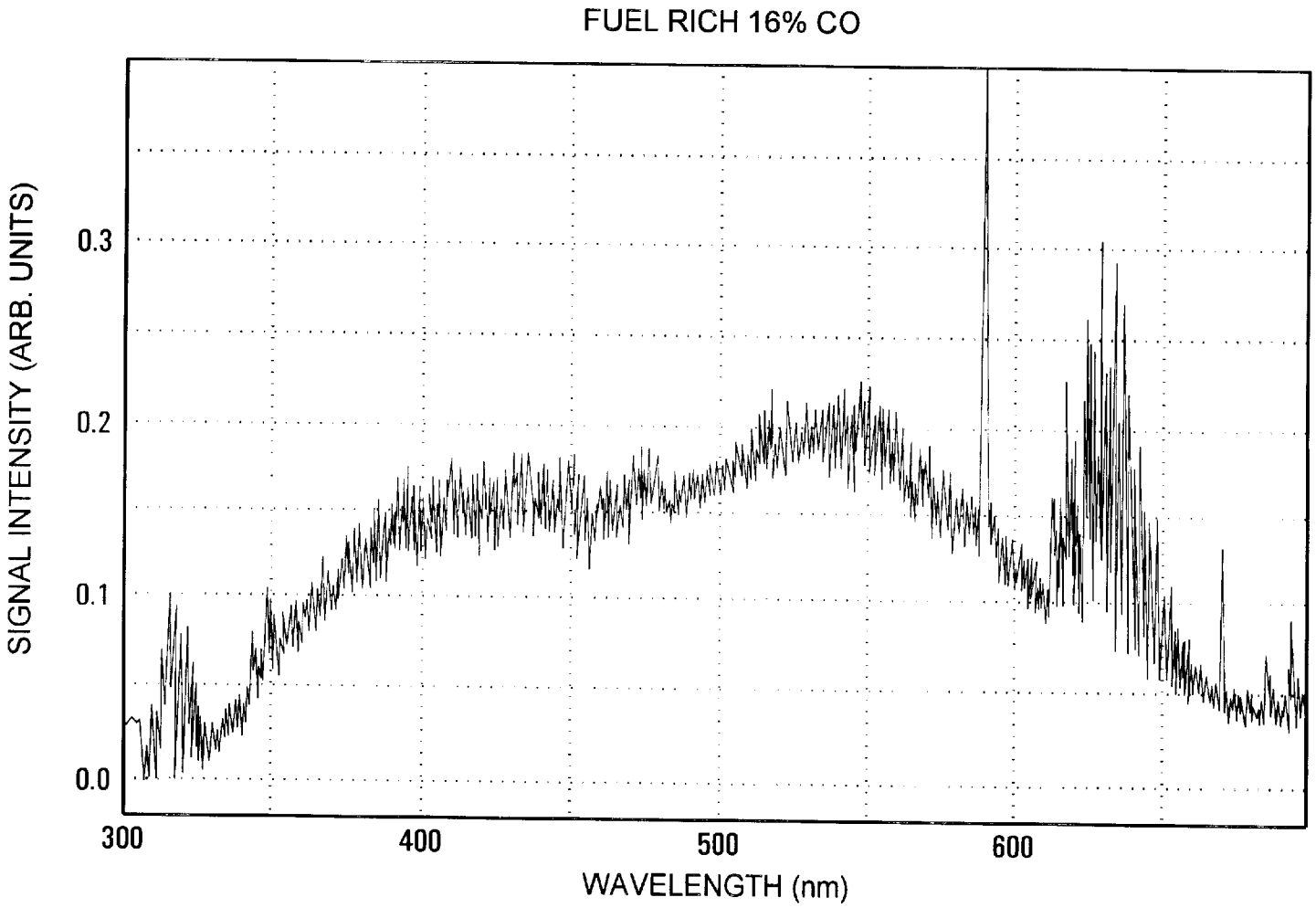
FIG. 7 represents the flame emission spectra of a flame operated under fuel lean conditions.
Figure 8:
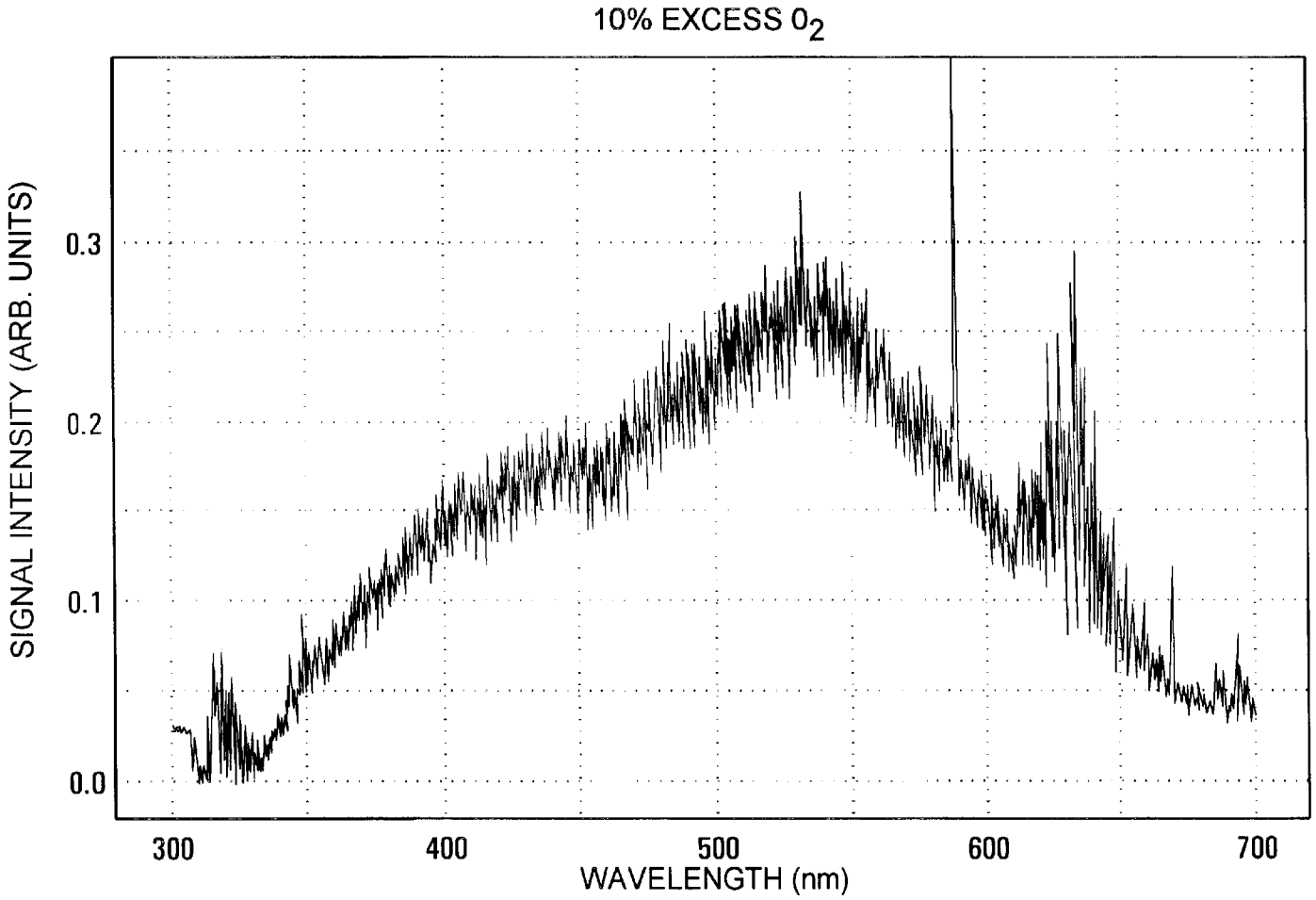
FIG. 8 represents the flame emission spectra of a flame operated under fuel rich conditions.

This behavior is illustrated graphically in FIGS. 7 and 8. FIG. 7 represents the visible emission of a flame generated by an oxygen-natural gas burner similar to the one illustrated in FIG. 2, when there is an excess of fuel (fuel rich). FIG. 8 represents the visible emission spectrum of the same flame with flowrates of natural gas and oxygen such that there is an excess of oxygen of 10% (fuel lean). At 530 nm, there is a weaker signal when the combustion mixture is fuel rich than when the mixture is fuel lean.

The signal obtained can then be compared to a calibration curve relating signal intensity to firing stoichiometry. Depending on the desired operating conditions, control action on the fuel and oxidant flows can be performed to adjust the burner fuel and/or oxidant flows to optimize the flame. For example, if a reducing atmosphere is desirable one would want to adjust the fuel and/or oxidizer such that the observed continuum intensity decreases. Again using the apparatus illustrated in FIG. 1, every burner used in the process could be individually monitored.

Toward the infrared region of the spectrum, flame emission related to soot could also be monitored. Since soot is a particle, it behaves as a black body, with broadband emission, as opposed to gaseous species emission which occurs in specific regions (lines). In certain applications a sooty flame which increases the luminosity is desirable. On the other hand, soot formation in a flame can be an indication of incomplete combustion of the fuel, which requires an adjustment of the combustion ratio. Monitoring of the appropriate spectral region will provide information for the process control action required.

EXAMPLE 3

Monitoring Chemical Tracers

In this application chemical tracers may be added to fuel and/or the oxidant streams directly, or entrained into the flame from the surrounding environment. For example, the introduction of particles into the flame, such as titanium dioxide, can be used to monitor the temperature by using a two-color optical pyrometer technique. In this case the temperature is being determined from the radiation of light emitted by the particle. Two or more wavelengths are required to be monitored since the particle's emissivity is often unknown.

EXAMPLE 4

Monitoring the Burner Firing Rate

This application is similar to Example 2, in that the emission intensity is related to the firing rate of the burner. In this case a calibration would be required to relate the observed signal at some selected wavelength to the burner firing rate. Once this information is known control of the firing rate can be adjusted accordingly by the BLC.

EXAMPLE 5

Environmental Combustion Monitoring

The detection of pollutants such as, NOx or SOx may be directly or indirectly monitored. However, it is difficult to quantify these pollutants because the observed signal is both temperature and concentration dependent, but one could monitor gross changes in the observed signal levels. For example, NOx could be directly monitored in the ultraviolet spectra region near 226 nm. Alternatively NOx may be indirectly monitored from the OH (hydroxyl radical) emission signal. A strong OH emission signal has been discovered to indicate a corresponding increase in measured NOx (provided $N_2$ is present) levels from the exhaust stack of our pilot furnace. In either case the method provides a means of determining gross changes in pollutant formation occurring for an individual burner.

The numerous examples described above using the inventive burner-mounted optical flame control apparatus illustrates the variety of applications where such a device can be found useful for industrial application.

Certainly this list of applications is not all inclusive and additional applications could be thought of, depending on the process requirements.

Examples

Experiments were conducted using a burner and optical coupling as illustrated in FIG. 3. The optical coupling device was attached to a standard burner known under the trade designation ALGLASS available from Air Liquide America Corp., Houston, Tex. The burner had an output of 1.2 MMBtu/hr (using oxygen 99% pure as oxidant) allowing flame emission spectra to be collected through the natural gas (NG) injector. Ultraviolet and visible flame radiation covering a spectral rage of 300–700 nm were collected for different combustion stoichiometries defined in terms of equivalence ratio (Φ), wherein:

$$\Phi = \frac{\text{actual fuel/oxidant (vol/vol)}}{\text{stoichiometric fuel/oxidant (vol/vol)}}$$

for stoichiometric operating conditions, $\Phi=1$, whereas for fuel-lean conditions $\Phi<1$, and for fuel-rich conditions $\Phi>1$. Results showing the variation of the flame emission spectra for different values of Φ are graphically illustrated in FIG. 9. The spectra were obtained using a fiber optic placed and lens positioned externally to the burner. Flame emission was collected through the natural gas (NG) injector and window mounted on the burner as shown in FIG. 3. The fiber optic was coupled to a 0.5 micrometer Acton monochromator with a Hamamatsu 1P28A photomultiplier (PMT) detector. The emission spectra shown in FIG. 9 was obtained by scanning the monochromator over a specified wavelength region, in this case from 300 to 700 nm. The signal from the PMT was then processed in a EG&G 4402 Boxcar averager.

Figure 9:
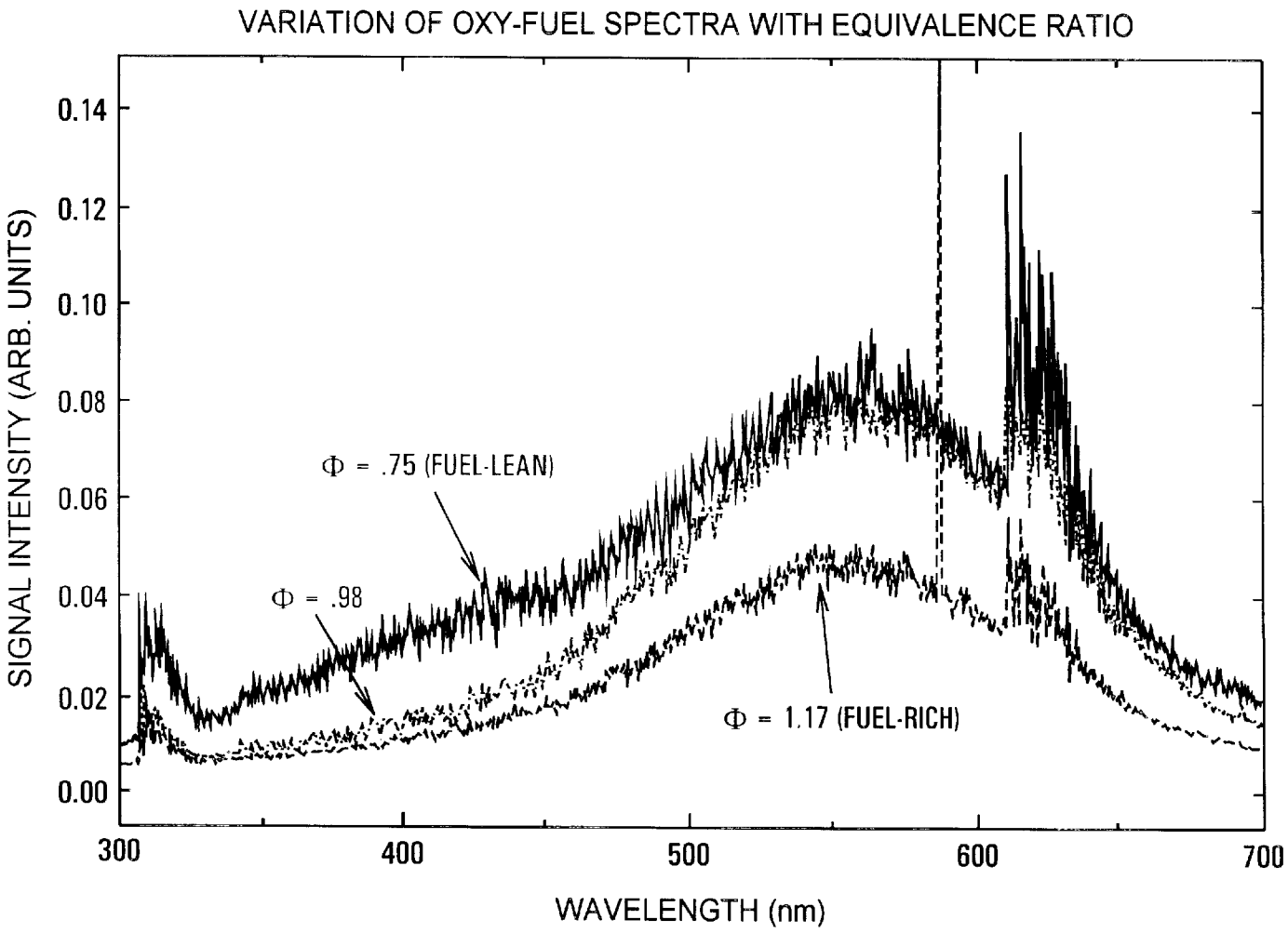
FIG. 9 represents the flame emission spectra obtained for three different burner operating conditions.
Figure 10:
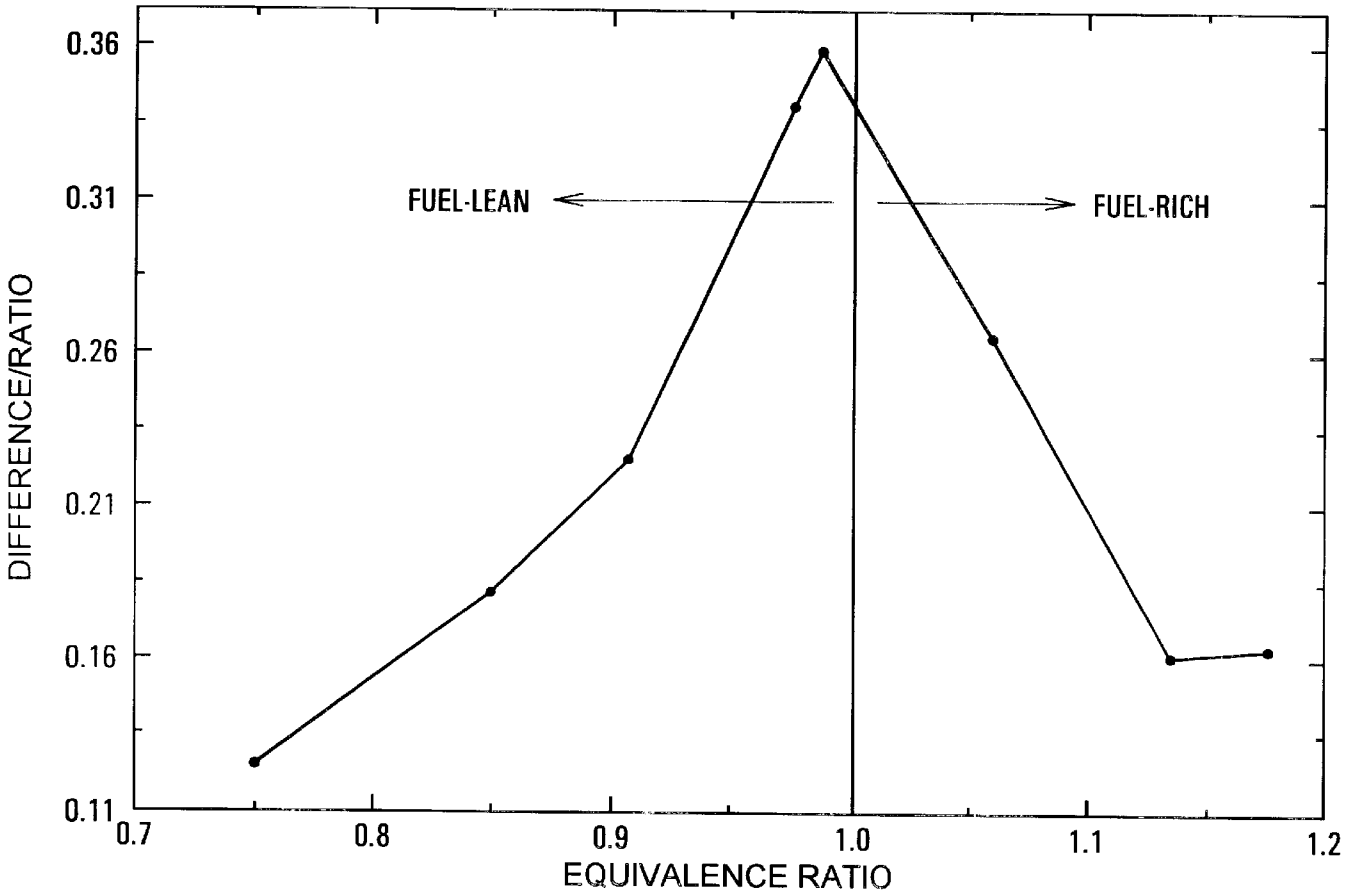
FIG. 10 is a graphical representation of the relationship between emission spectra and stoichiometry.

From FIG. 9, a number of distinct differences relative to the stoichiometric spectra ($\Phi=0.98$) were seen. First, for Φ=0.75 the continuum below 550 nm and the OH (hydroxyl radical) band were noticeably stronger, but above 550 nm the distinction was not so clear when compared to the Φ=0.98 spectra. Second, for Φ=1.17 the continuum below 425 nm was only slightly different from the Φ=0.98 case, but a significant difference was seen near 550 nm. These results suggested that the spectral region near 400 nm and 550 nm could be used for relating the observed flame emission to the stoichiometry. Both regions are necessary to account for fuel-lean and fuel-rich operating conditions. By manipulating the data a relationship between these spectral regions and the stoichiometry was developed, as illustrated in FIG. 10. From FIG. 10 a maximum near Φ=1 is seen with a sharp decrease on either side of the maximum as fuel-lean or fuel-rich operating conditions were approached.

Various modifications to the described preferred embodiments will be envisioned by those skilled in the art; however, the particular embodiments herein should not be construed as limiting the scope of the appended claims.

What is claimed is:

1. Apparatus for fuel burner control comprising:

(a) means for viewing an optical spectrum of flame radiation emitted by a flame from a burner to collect flame radiation intensity as a function of time, said means for viewing being integral with the burner;

(b) means for optically transporting the optical spectrum of flame radiation emitted by said flame from said burner into an optical processor;

(c) an optical processor for selecting one or more specific spectral regions of the optical spectrum of flame radiation and means for converting said one or more specific spectral regions into first electrical signals indicative of flame radiation intensity for those spectral regions over time;

(d) a signal processor for integrating flame radiation intensity for the specific spectral regions over time and creating second electrical signals; and (e) control means which accept the second electrical signals from the signal processor and produce an output acceptable to either an oxidant flow control means, a fuel flow control means, or to both an oxidant flow control means and a fuel flow control means.

2. Apparatus in accordance with claim 1 wherein said means for viewing is selected from the group consisting of a window on the burner and an optical fiber.

3. Apparatus in accordance with claim 1 wherein said means for transporting comprises optical elements selected from the group consisting of: a plurality of lenses, an optical fiber, optical beam splitters and optical filters.

4. Apparatus in accordance with claim 1 wherein said optical processor means is selected from the group consisting of optical detectors, photomultipliers, photodiodes, and array detectors.

5. Apparatus in accordance with claim 1 wherein the signal processing means is selected from the group consisting of analog/digital converters, amplifiers, line drivers, and combinations thereof.

6. Apparatus in accordance with claim 1 wherein said control means comprises a programmable logic controller.

7. An integrated fuel burner and stoichiometry control apparatus comprising:

(a) the fuel burner control apparatus of claim 1; and (b) a burner housing having at least one fuel injector and at least one oxidant injector, wherein said means for viewing light is an optical fiber positioned within at least one of the fuel or oxidant injectors in a position suitable for viewing said flame.

8. An integrated fuel burner and stoichiometry control apparatus comprising:

(a) the fuel burner control apparatus of claim 1; and (b) a burner housing having at least one fuel injector and at least one oxidant injector, wherein said means for viewing light comprises a window positioned on the burner housing in a position suitable for viewing said flame.

9. Apparatus in accordance with claim 7 wherein said means for optically transporting the viewed light comprises one or more elements selected from the group consisting of optical fibers, beam splitters, optical filters, dispersion devices, photomultiplier tubes, and photo diodes.

10. Apparatus in accordance with claim 8 wherein said means for optically transporting the viewed light comprises one or more lenses.

11. A method of controlling the combustion ratio of a burner, the method comprising the steps of:

(a) viewing an optical spectrum of flame radiation emitted by a flame from a burner to collect the flame radiation intensity as a function of time;

(b) optically transporting the optical spectrum of flame radiation into an optical processor;

(c) selecting one or more specific spectral regions of the optical spectrum using said optical processor, and converting said specific spectral regions into first electrical signals indicative of flame radiation intensity over time;

(d) integrating the flame radiation intensity of those specific spectral regions over time to produce second electrical signals; and (e) controlling the input of an oxidant, a fuel, or both oxidant and fuel into the burner using the second electrical signals.

12. Method in accordance with claim 11 wherein the light from the flame is viewed by a first optical fiber and transported to an optical processor using a second optical fiber.

13. A method of operating a burner comprising the steps of:

(a) monitoring flame emission from a burner through a fiber optic attached to a spectrometer, the fiber optic positioned in the burner;

(b) holding variables OC (optical collection system), OD (optical detector), and O (oxidizer), F (fuel), B (burner characteristics), and process disturbances constant while independently varying the variables P (burner power) and S (combustion stoichiometry) to obtain a family of curves for the value of Γ (intensity) of OH emission at constant P while varying S, and at constant S while varying P;

(c) solving the equation:

$$d\Gamma = \left(\frac{\partial \Gamma}{\partial S}\right)_P dS + \left(\frac{\partial \Gamma}{\partial P}\right)_S dP$$

by integrating from $(S_1, P_1)$ to $(S_2, P_2)$ first at constant P, then at constant S, to obtain the intensity (Γ) of OH emission of the flame; and (d) adjusting one of a fuel control means or an oxidizer control means, or both, based on the Γ value.

14. A method of monitoring in real time operating conditions of a burner comprising:

(a) monitoring flame radiation emission of a burner through a fiber optic attached to a means for collecting specific spectral regions of the radiation, the fiber optic positioned in the burner;

(b) holding variables OC (optical collection system), OD (optical detector), O (oxidizer), F (fuel), B (burner characteristics), ρ (processed disturbances), and P (burner power) constant while varying S (combustion stoichiometry), to determine $\Gamma_\rho = f(S)$ by monitoring integrated OH emission intensity;

(c) calculating constants A and B from a graph of $\Gamma = AS + B$; and (d) monitoring in real time stoichiometry $S_2$ using the equation.

* * * * *

UNITED STATES PATENT AND TRADEMARK OFFICE

CERTIFICATE OF CORRECTION

PATENT NO. : 5,829,962

DATED : NOV. 3, 1998

INVENTOR(S) : William Von Drasek, Louis C. Philippe, and Eric Duchateau

It is certified that error appears in the above-identified patent and that said Letters Patent is hereby corrected as shown below:

In Claim 14, column 14, line 5 add:

$$S_2 = S_1 + (\Gamma_2 - \Gamma_1) / A$$

Signed and Sealed this

Twenty-ninth Day of August, 2000

*Attest:*

*Attesting Officer*

Q. TODD DICKINSON

*Director of Patents and Trademarks*